US006857305B2

(12) United States Patent
Essen

(10) Patent No.: US 6,857,305 B2
(45) Date of Patent: Feb. 22, 2005

(54) HYDRAULIC SWAGE PRESS

(75) Inventor: Fred Van Essen, Williamstown (AU)

(73) Assignee: Betaswage Pty. Ltd., Victoria (AU)

( * ) Notice: Subject to any disclaimer, the term of this patent is extended or adjusted under 35 U.S.C. 154(b) by 0 days.

(21) Appl. No.: 10/346,578

(22) Filed: Jan. 17, 2003

(65) Prior Publication Data

US 2003/0230128 A1 Dec. 18, 2003

Related U.S. Application Data

(63) Continuation of application No. PCT/AU01/00874, filed on Jul. 19, 2001.

(30) Foreign Application Priority Data

Jul. 19, 2000 (AU) ..... PQ 8862

(51) Int. Cl.[7] ..... B21D 39/04
(52) U.S. Cl. ..... 72/402; 29/237
(58) Field of Search ..... 72/402; 29/237, 29/283.5, 282

(56) References Cited

U.S. PATENT DOCUMENTS 2,988,727 A * 6/1961 Berndt ..... 439/863
3,768,298 A * 10/1973 Olive-Jones et al. ..... 72/402
4,306,442 A * 12/1981 Schrock ..... 72/402
4,614,107 A * 9/1986 Norin ..... 72/402
4,766,808 A * 8/1988 Schrock ..... 100/232
5,657,656 A * 8/1997 Evans et al. ..... 72/14.8
6,415,488 B1 * 7/2002 Muto ..... 29/237

FOREIGN PATENT DOCUMENTS

DE 25 23 159 A1 12/1976
DE 199 58 103 C1 3/2001

* cited by examiner

*Primary Examiner*—Daniel C. Crane
(74) *Attorney, Agent, or Firm*—Alston & Bird LLP

(57) ABSTRACT

The present specification discloses a swaging press including a piston member co-operable with a plurality of die shoes to drive the die shoes inwardly upon axial movement of the piston member during a swaging operation, the piston member having a frusto-conical recessed region divided into a plurality of circumferentially disposed bearing surface zone of a defined axial length, each of the bearing surface zones having an inner axial end with a numerical radius of curvature less than or equal to the radius of curvature of a circular line forming the lateral edges of each of the bearing surface zones at the inner axial end whereby at least 50% of the outer bearing surface of each said die shoe remains in bearing engagement with the adjacent said bearing surface zone over the axial movement of the piston member during a swaging operation.

32 Claims, 6 Drawing Sheets

HYDRAULIC SWAGE PRESS

CROSS-REFERENCE TO RELATED APPLICATION

This application is a continuation of International Patent Application No. As PCT/AU01/00874 filed Jul. 19, 2001, which designated inter alia the United States and was published under PCT Article 21(2) in English.

FIELD OF THE INVENTION

BACKGROUND OF THE INVENTION

The present invention relates to an improved hydraulic swage press.

Hydraulic swage presses are machines that with an array of suitable tooling called "dies", are able to reduce a product from one diameter to a smaller diameter in a cold state. The product may typically be made of steel and may be of cylindrical form but this is not necessarily the case. In the fluid power connector sector, particularly the previously described "product" is called a ferrule and is used to connect a hose to hose end. Ferrule type connectors are of course also used in other industries, however, increasing demands in the fluid power sector, such as increasing pressure and longer endurance levels, mean that ferrules in that industry are required to do more work and, as a result, higher performance of the swage press is continually sought.

One conventional form of swage press design can generally be described as the "cone" type. This type of swage press utilises a piston driven by hydraulic pressure with the piston having a forward operational face recessed in a frusto-conical configuration. This operational face is adapted to co-operate with a series of shoes, each carrying an inwardly facing die, with the shoes having an outer part frusto-conical surface co-operable with the operational face of the piston. In use, as the piston moves forward under applied hydraulic pressure, forward movement of the shoes is prevented and as a result the shoes and connected dies must move inwardly to provide a swaging movement. Many variations of this basic core type design are possible including twin cone arrangements. The advantages of this design include ease of manufacture and therefore low cost, compactness, and a mechanical gain where the thrust exerted by the piston onto the dies can be as much as 3:1 due to the cone angle of the piston. Some disadvantages of the cone design include the "depth" of the assembly and the strain in the configuration due to mis-matching curvature of the frusto-conical surface in the piston and the part frusto-conical surfaces on the co-operating die shoes. This mis-matching of curvatures causes bearing to actually occur only along a line where the curves actually match which means, under load, that the conical surfaces actually distort and there is a significant impingement of varying degrees depending on load and relative piston position. As the actual measurement of the final swage diameter is made at the piston, accuracy suffers as well. The bearing load at this point is extreme and many machines of this type seize under load without significant amounts of lubrication.

To overcome some of the shortcomings of the cone type design, another form of swage press has been developed which may be described as a 'scissor' type. This type of swaging press utilises a piston driven by hydraulic pressure having a forward V-shaped recess with flat bearing surfaces that, under pressure, moves toward a reaction block also having a V-shaped recess with flat bearing surfaces. Die carrying shoes are located between the piston and the reaction block having flat bearing surfaces engaging with either the bearing-surfaces of the piston or the reaction block. The shoes (except those located in the corners of the V-shaped recesses) slide along the bearing surfaces as the piston moves toward the reaction block during a swaging operation. The die carrying shoes are maintained spaced from one another by spring members located between the shoes. The advantages of the scissor type design is that its dimension from front to rear is small compared to a similar dimension of the cone type. In addition, the scissor type design has high loading capability due to the full surface bearing contact described above. A significant disadvantage is, however, that it has a high manufacturing cost due mainly to the 1:1 mechanical gain (i.e. 1 mm of piston movement=1 mm change in swaging diameter) whereas the cone type may have as much as 3:1 mechanical gain. As a result, the piston in a scissor type press will be much larger than in the cone type press.

A further variation of the cone type swaging press may involve machining the frusto-conical surface of the piston in an octagonal shape, in the case of an eight die press, with eight essentially flat but inclined bearing surfaces, each co-operating with a flat but inclined bearing surface on the die shoe. The octagonal configuration would vary depending on the number of dies used in the press. This type of swage press requires guide members to be located between the shoes with spring members also acting between the shoes similar to the spring members in the scissor type design. This arrangement has the advantage that it has a full contact bearing surface engagement similar to the scissor type machine but also has a mechanical gain advantage similar to a cone type design. The disadvantages of this design include that it is difficult to manufacture and the configuration, under radial load, results in the shoes tending to slide to the corners of the octagonal cone as this represents the outer most reactive low energy position. This means that the shoe guides mentioned above must be inserted between the shoes to keep them in correct position. Any wear in the guides will create irregular swaging action.

In general, as the performance requirements of swage press equipment has increased, manufacturers are tending to produce scissor type designs or cone type designs but of larger diameter where the curvature of the cones are less mis-matched.

As the requirements of swage machines has increased with higher swaging loads, so has their flexibility. In earlier days, the swaging diameter was controlled by manufacturing different die sets of varying diameter with the piston moving to one fixed position (the end of stroke). In this position maximum bearing area is achieved with matching cone curvature. Many of these machines cost more in die tooling than in the actual cost of the swage press itself. More contemporary machines control the forward motion of the piston and hence are able to achieve a wide variation of finished swage diameters with a minimal amount of die tooling.

SUMMMARY OF THE INVENTION

The objective of the present invention is to provide an improved swaging press that retains the manufacturing, cost and size advantages of cone type swaging presses while achieving performance capabilities similar to scissor type machines.

Accordingly, the present invention provides a swaging press including a piston member adapted in use to drive die shoes inwardly during a swaging process, said piston member including a recess formed frusto-conically and divided into a plurality of circumferentially disposed bearing surface zones of a defined axial length, each said bearing surface zone having an inner axial end with a numerical radius of curvature less than or equal to that of the frusto-conically formed region of said piston at said inner axial end of the bearing surface zone.

In one preferred embodiment, the inner axial end of the bearing surface zones together form a circle having a first radius of curvature with axially outer ends of the bearing surface zones being curved in a concave manner with a radius of curvature equal to the first radius of curvature. Preferably, the radius of curvature of the bearing surface zones at any axial distance from said inner end is equal to said first radius of curvature. In a second preferred embodiment, each of the bearing surface zones at the inner axial end thereof has a first radius of curvature that is less than that of a circle connecting adjacent edges of each said bearing surface zone whereby a concave scalloped formation is achieved at said inner axial end of the bearing surface zones. Preferably, the radius of curvature of the bearing surface zones at any axial distance from said inner end is equal to said first radius of curvature. Preferably each bearing surface zone occupies a predetermined circumferential portion of the recessed zone with the circumferential portions being equal or different. It is, however, preferred that the circumferential portions be of equal distance at each axial location from the inner axial end.

Preferred features and aspects of this invention are as defined in claims 2 to 16 annexed hereto which are hereby made part of this disclosure.

BRIEF DESCRIPTION OF THE DRAWINGS

The following describes preferred embodiments of this invention with comparisons made to prior art swaging presses, the description being given in relation to the accompanying drawings, in which:

FIG. 6*a* is a perspective view of die shoe co-operable with the piston shown in. FIG. 4;

DETAILED DESCRIPTION OF PREFERRED EMBODIMENTS

Figure 1:
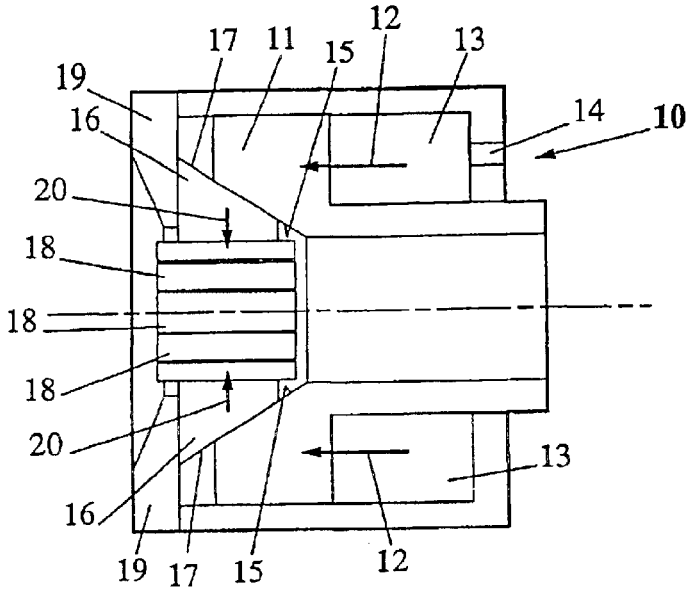
Fig 1. (Prior Art)
FIG. 1 illustrates schematically in cross-sectional view, a conventional cone type swage press.
Figure 1A:
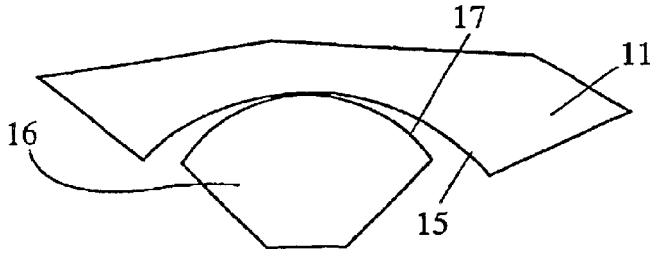
Fig 1a. (Prior Art)
FIG. 1*a* illustrates graphically the contact area between a piston and a die shoe in a typical cone type swage press.

Referring first to FIGS. 1 and 1*a*, a conventional form of cone type swage press 10 is schematically illustrated employing an operational piston 11 driven in a forward direction 12 by pressurised hydraulic fluid entering chamber 13 via port 14. The forward end face of the piston 11 is recessed to form a frusto-conical surface 15 which co-operably engages with part frusto-conical surfaces 17 on the shoe members 16, each said member 16 carrying a die 18 facing inwardly. The die shoes 16 are restrained against forward movement by an end wall 19 of the press assembly whereby the shoes move inwardly as shown by direction arrows 20 when the piston 11 moves in a forward direction 12. As shown in FIG. 1*a*, the bearing contact region between the die shoes 16 and the frusto-conical surface 15 of the piston 11 is essentially a line resulting from the method of manufacturing same. As a result a reasonably long bearing area is required resulting in turn in a press assembly that is relatively long in the forward direction of movement 12 of the piston, as well as the other problems discussed earlier in this specification.

Figure 2:
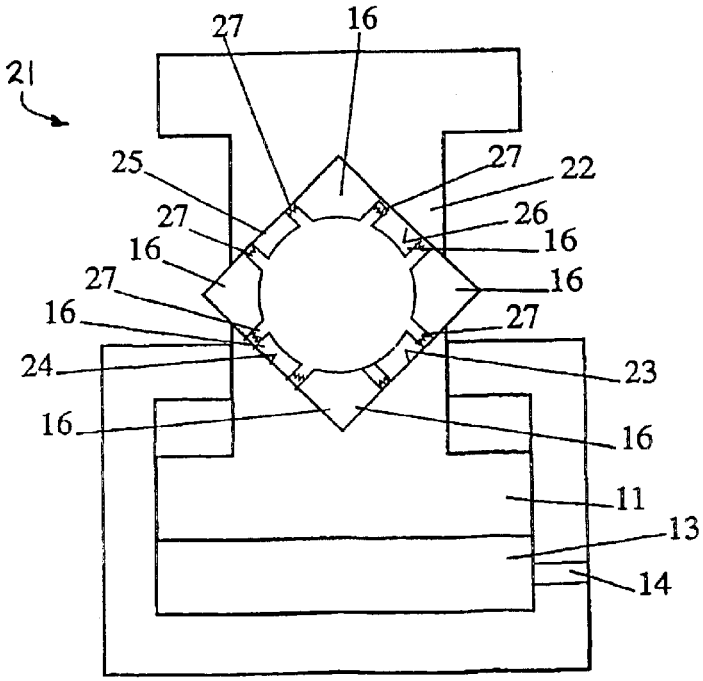
Fig 2. (Prior Art)
FIG. 2 illustrates schematically in cross-sectional view, a conventional scissor type swage press.

FIG. 2 illustrates another known type of swage press 21 discussed in the foregoing as a scissor type swage press. In this type of press the piston member 11 is caused to move towards a reaction block 22 with the confronting faces of the block 22 and the piston 11 being formed by V-configured flat bearing surfaces 23; 24, 25 and 26. The bearing surfaces 23–26 slidably support flat bearing surfaces on the die shoes 16 which in turn are also separated by spring members 27. The configuration is such that as the piston 11 moves in a forward direction 12, the die shoes (except the shoes in the corner of the V) slide along the bearing surfaces 23–26 and effectively reduce the Internal zone between the dies. These machines work satisfactorily but are expensive to produce and are quite large because of the size of the piston required.

Figure 3A:
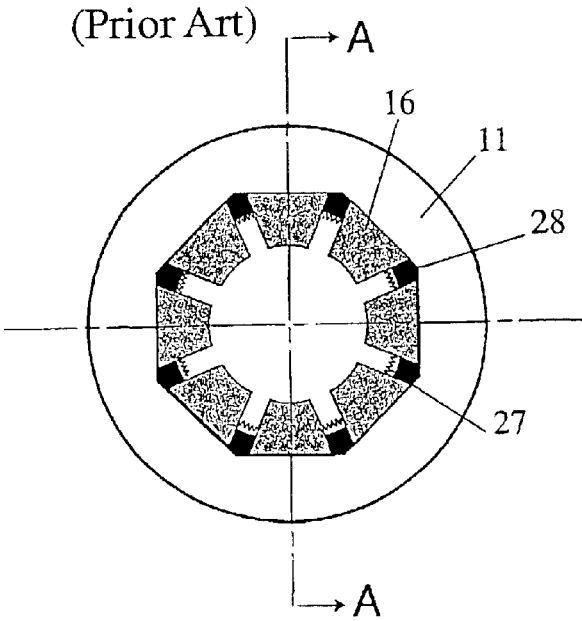
Fig 3a. (Prior Art)
FIG. 3*a* illustrates schematically in cross-sectional view, a conventional octagonal-cone type swage press.
Figure 3B:
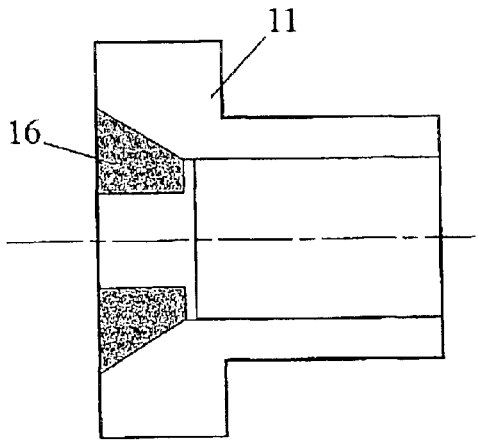
Fig 3b. (Prior Art)
FIG. 3*b* is a sectional view along line A—A of FIG. 3*a;*

FIGS. 3*a* and 3*b* Illustrate a modified cone type swags press referred to as an octagonal cone type press in the preceding specification. In this case the die shoes 16 have flat inclined bearing surfaces engaging with flat inclined bearing surfaces of the piston 11. Each die shoe 16 is separated by guide members 28 and spring members 27.

Figure 4:
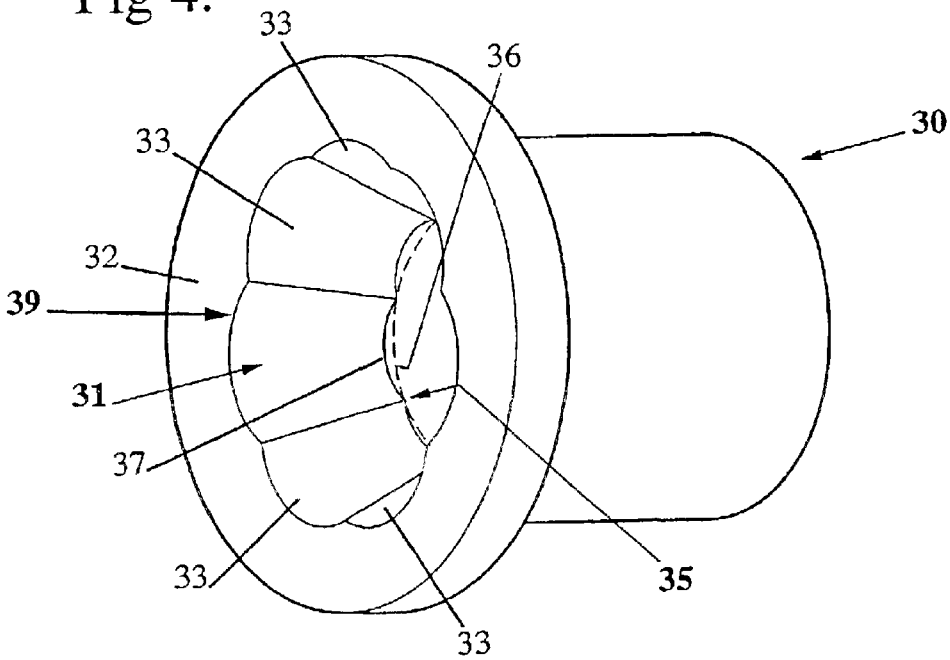
FIG. 4 illustrates in perspective view an operating piston of the type which might be used in a swage press according to the present invention.
Figure 4A:
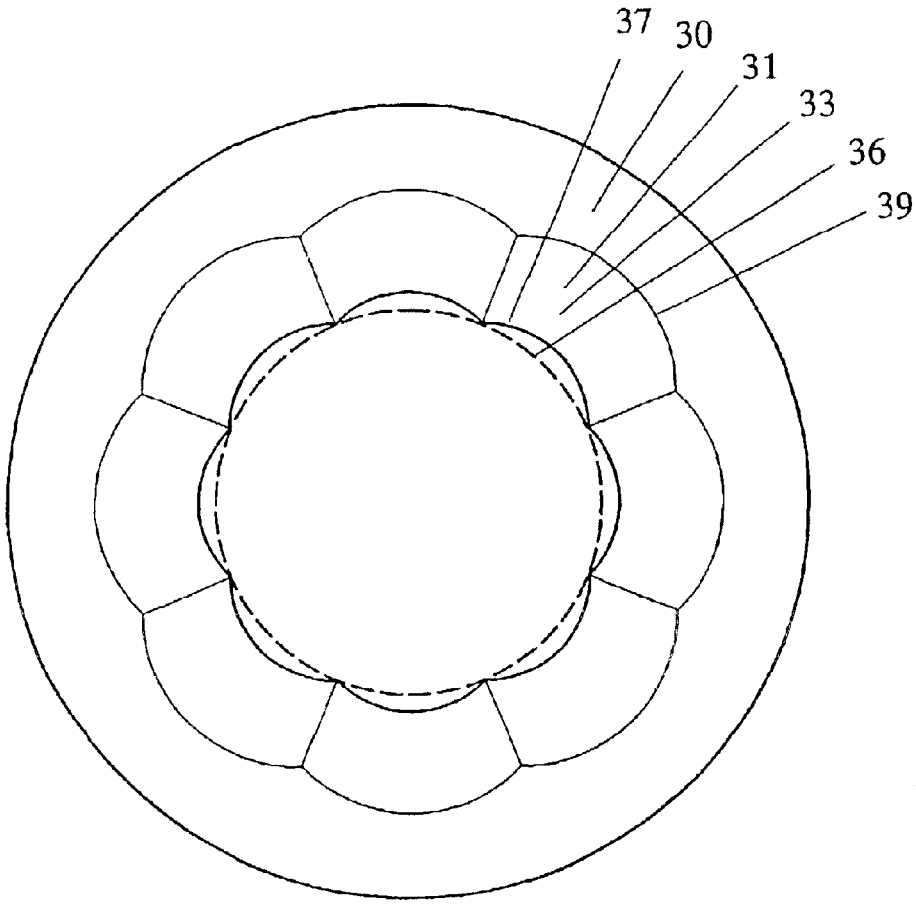
FIG. 4*a* shows a front elevation view of the operating piston shown in FIG. 4.
Figure 5A:
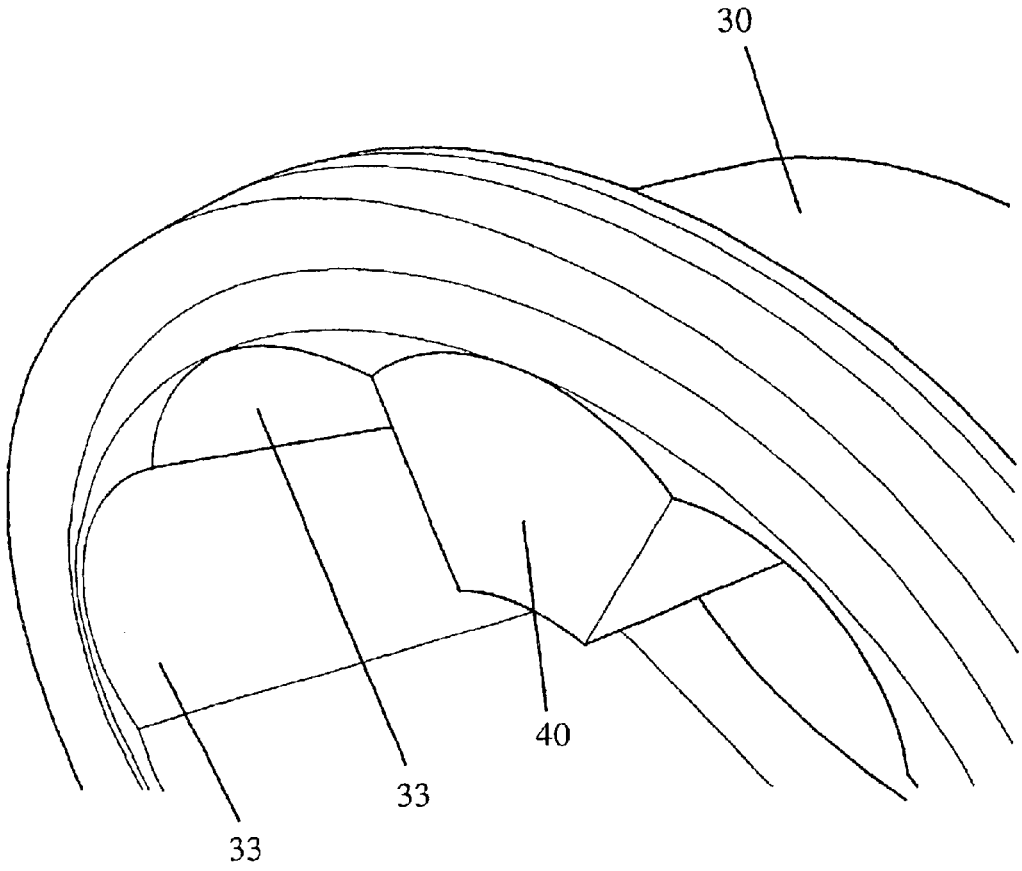
FIG. 5*a* shows in partial perspective view a die shoe cooperating with an operating piston of the type shown in FIGS. 4 and 4A, it being recognised that in practice, a similar die shoe would be provided cooperating with each bearing surface zone of the operating piston.
Figure 5B:
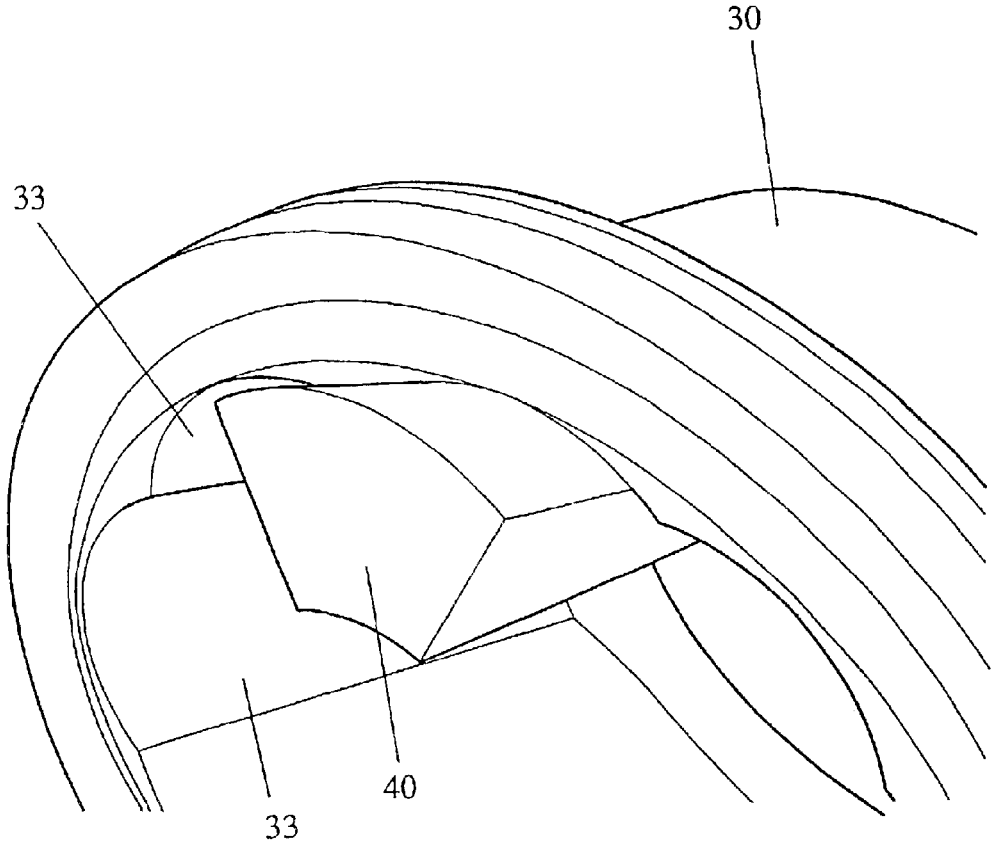
FIG. 5*b* shows a view similar to FIG. 5B but illustrating a different position of the die shoe after axial movement of the operating piston.
Figure 6A:
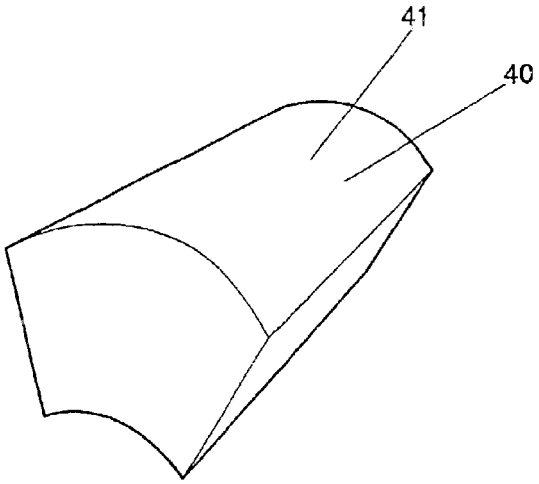
Figure 6B:
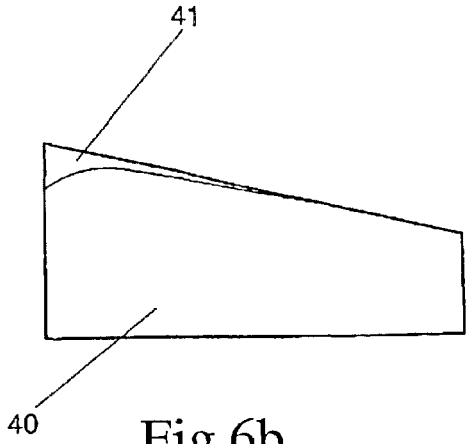
FIG. 6*b* is a side view of the die shoe shown in FIG. 6*a*.

Referring now to FIGS. 4, 4*a*, 5*a* and 5*bi* a preferred form of piston member 30 is shown capable of use in swaging apparatus according to the present invention. The piston member 30 has a recessed frusto-conical region 31 on its forward face 32, however, the region 31 is divided into separate circumferential zones 33 each corresponding to a die shoe part 34 (FIGS. 6*a*, 6*b*) used in the press assembly. Each individual zone 33 is concave formed with a radius of curvature 37 at an inner end 35 being smaller than or equal to the radius of curvature of a circular line 36 joining the lateral edges of each section 33 at the Inner end 35 of the frusto-conical region 31. Conveniently, the radius of curvature 38 of each section 33 at its outer end 39 is equal to the radius of curvature 37 at its inner end 35. Preferably the radius of curvature of the sections 23 is substantially the same along its length from its inner end 35 to the outer end 39. The co-operating die shoes 40 have an outer bearing surface 41 which also has a radius of curvature at both ends and preferably along its length equal to the radius of curvature 37, 38 of the piston zones 33. As is best seen in FIGS. 5*a* and 5*b*, the bearing surface of each zone 33 exactly corresponds to the outer bearing surfaces 41 of the die shoes such that at least 50% and preferably at least 70% bearing engagement occurs between the adjacent bearing surfaces of the two parts.

Figure 7:
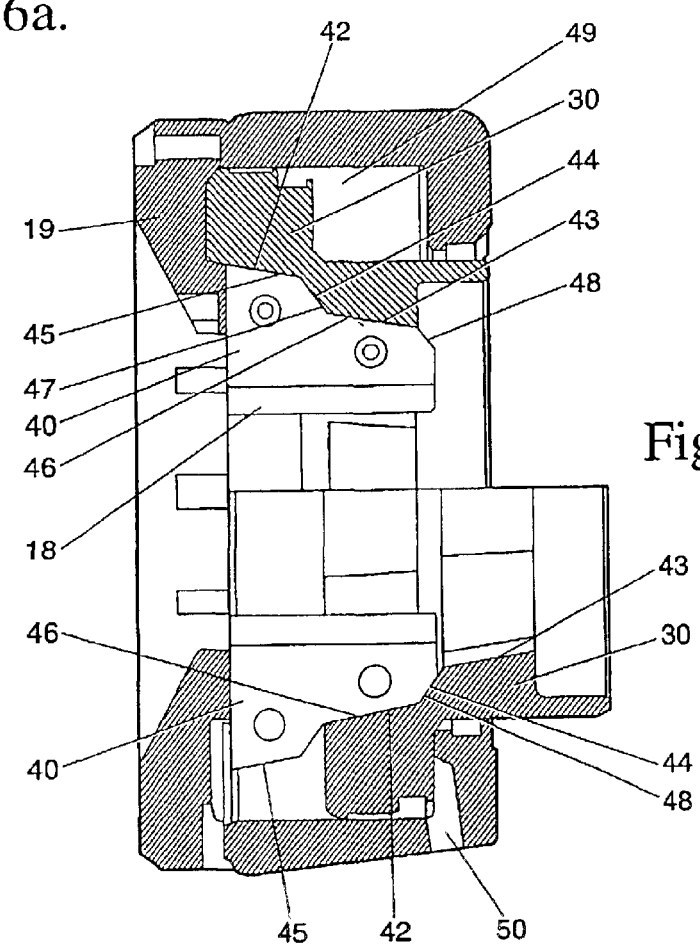
FIG. 7 is a cross-sectional view illustrating two positions of use of a swage press including an intermediary ramp section according to a further embodiment of the present invention.

FIG. 7 illustrates in cross-sectional view a swaging press in accordance with one preferred embodiment of the present invention. This press illustrates how the bearing sections 33 of the piston 30 may be formed in two axially separate sections 42 and 43 with a ramp section 44 therebetween. The die shoes 40 may have their bearing surfaces 41 similarly separated into two axial sections 45, 46 also separated by a ramp section 47 and having a lead in ramp section 48 at their inner ends to allow for rapid approach of the die shoes 40 to the swaging position. Movement of the piston 30 is achieved by introducing pressurised hydraulic fluid into chamber 49 via port 50. The lower half of FIG. 7 shows the piston 30 in a withdrawn position with the die shoes 40 also in the outer circumferential position. The upper half of FIG. 7 shows the piston 30 moved forward in an axial direction-after-the-introduction of pressurised hydraulic fluid Into the chamber 49 with the die shoes consequently moved radially inwardly to perform a swaging operation.

As a result, a "clover leaf" type configuration is formed as shown in FIGS. 4 and 4*a* which is easy to manufacture and provides for full curvature matching at all operational positions of the piston 30, between the piston bearing surfaces 33 and the bearing surfaces 41 of the die shoes 40. Moreover, unlike the octagonal-cone type arrangement (FIG. 3*a*),it has a natural position under load without the need for shoe guides. The configuration provides all the ease of manufacture and traditional advantages of a cone type swaging press with the stability, bearing area engagement, and accuracy of a scissor type swaging press. The clover leaf design maximises the bearing contact allowing the zone (or multiple cone sections) to be shorter and hence the swaging press as a whole may be shorter than a conventional cone type machine.

What is claimed is:

1. A swaging press including a piston member adapted in use to drive die shoes inwardly during a swaging process, said piston member including a recess formed frusto-conically and divided into a plurality of circumferentially disposed bearing surface zones of a defined axial length, each said bearing surface zone having at least an axial section with a radius of curvature less than that of the frusto-conically formed region of the piston at axial locations of the axial section and having an inner axial end with a numerical radius of curvature less than or equal to that of the frusto-conically formed region of said piston at said inner axial end of the bearing surface zone.

2. A swaging press according to claim 1 wherein the inner axial end of each said bearing zone has a numerical radius of curvature less than that of the frusto-conically formed region of said piston at said inner axial end of the bearing surface zone.

3. A swaging press according to claim 1 wherein an outer axial end of each said bearing surface zone has a numerical radius of curvature less than that of the frusto-conically formed region of said piston member at said outer axial end of the bearing surface zone.

4. A swaging press according to claim 3 wherein the radius of curvature of said inner end of said bearing surface zone is equal to the radius of curvature of the outer end of said bearing surface zone.

5. A swaging press according to claim 4 wherein the radius of curvature of each said bearing surface zone is uniform along the axial length of said bearing surface zone.

6. A swaging press according to claim 1 wherein the outer end of each said bearing surface zone coincides with a front face of the piston member.

7. A swaging press according to claim 1 wherein at each circumferential position, at least two said bearing surface zones are provided axially in line separated by a ramp surface forming an angle to the direction of movement of the piston member greater than that of each of said bearing surface zones.

8. A swaging press according to claim 1 wherein a die shoe is provided co-operable with each said bearing surface zone, each said die shoe having an outer bearing surface circumferential zone engageable with a substantial portion of the adjacent said bearing surface zone over a substantial part of the movement of said piston member during a swaging operation.

9. A swaging press according to claim 8 wherein at least 50% of the circumferential zone of the outer bearing surface of each said die shoe remains in bearing engagement with the adjacent said bearing surface zone over the movement of said piston member during a swaging operation.

10. A swaging press according to claim 9 wherein at least 70% of the circumferential zone of the outer bearing surface of each said die shoe remains in bearing engagement with the adjacent said bearing surface zone over the movement of said piston member during a swaging operation.

11. A swaging press according to claim 8 wherein substantially all of the circumferential zone of the outer bearing surfaces remain in bearing engagement with the adjacent said bearing surface zone over the movement of said piston member during a swaging operation.

12. A swaging press including a piston member adapted in use to drive die shoes inwardly during a swaging process, said piston member including a recess formed frusto-conically and divided into a plurality of circumferentially disposed bearing surface zones of a defined axial length, each said bearing surface zone having an inner axial end with a numerical radius of curvature less than that of the frusto-conically formed region of said piston at said inner axial end of the bearing surface zone.

13. A swaging press according to claim 12, wherein an outer axial end of each said bearing surface zone has a numerical radius of curvature less than that of the frusto-conically formed region of said piston member at said outer axial end of the bearing surface zone.

14. A swaging press according to claim 13 wherein the radius of curvature of said inner end of said bearing surface zone is equal to the radius of curvature of the outer end of said bearing surface zone.

15. A swaging press according to claim 14 wherein the radius of curvature of each said bearing surface zone is uniform along the axial length of said bearing surface zone.

16. A swaging press according to claim 12, wherein said bearing surface zones form a series of concave surfaces around the circumference of said piston member recess, each said concave surface having a radius of curvature less than that of the frusto-conically formed piston member at axial locations of the frusto-conically formed piston member.

17. A swaging press according to claim 12 wherein at each circumferential position, at least two said bearing surface zones are provided axially in line separated by a ramp surface forming an angle to the direction of movement of the piston member greater than that of each of said bearing surface zones.

18. A swaging press including a piston member adapted in use to drive die shoes inwardly during a swaging process, said piston member including a recess formed frusto-conically and divided into a plurality of circumferentially disposed bearing surface zones of a defined axial length, each said bearing surface zone having an inner axial end with a numerical radius of curvature less than or equal to that of the frusto-conically formed region of said piston at said inner axial end of the bearing surface zone, and wherein a radius of curvature of each said bearing surface zone at an outer axial end is less than that of the frusto-conically formed region of the piston at said outer axial end.

19. A swaging press according to claim 18 wherein the radius of curvature of said inner end of said bearing surface zone is equal to the radius of curvature of the outer end of said bearing surface zone.

20. A swaging press according to claim 19 wherein the radius of curvature of each said bearing surface zone is uniform along the axial length of said bearing surface zone.

21. A swaging press according to claim 18 wherein said bearing surface zones form a series of concave surfaces around the circumference of said piston member recess, each said concave surface having a radius of curvature less than that of the frusto-conically formed piston member at axial locations of the frusto-conically formed piston member.

22. A swaging press according to claim 18 wherein at each circumferential position, at least two said bearing surface zones are provided axially in line separated by a ramp surface forming an angle to the direction of movement of the piston member greater than that of each of said bearing surface zones.

23. A swaging press according to claim 18 wherein a die shoe is provided co-operable with each said bearing surface zone, each said die shoe having an outer bearing surface circumferential zone engageable with a substantial portion of the adjacent said bearing surface zone over a substantial part of the movement of said piston member during a swaging operation.

24. A swaging press including a piston member adapted in use to drive die shoes inwardly during a swaging process, said piston member including a recess formed frusto-conically and divided into a plurality of circumferentially disposed bearing surface zones of a defined axial length, each said bearing surface zone having an inner axial end with a numerical radius of curvature less than or equal to that of the frusto-conically formed region of said piston at said inner axial end of the bearing surface zone, and wherein the numerical radius of curvature of each said bearing surface zone is uniform along its axial length.

25. A swaging press according to claim 24 wherein the inner axial end of each said bearing zone has a numerical radius of curvature less than that of the frusto-conically formed region of said piston at said inner axial end of the bearing surface zone.

26. A swaging press according to claim 24 wherein at each circumferential position, at least two said bearing surface zones are provided axially in line separated by a ramp surface forming an angle to the direction of movement of the piston member greater than that of each of said bearing surface zones.

27. A swaging press according to claim 24, wherein a die shoe is provided co-operable with each said bearing surface zone, each said die shoe having an outer bearing surface circumferential zone engageable with a substantial portion of the adjacent said bearing surface zone over a substantial part of the movement of said piston member during a swaging operation.

28. A swaging press including a piston member adapted in use to drive die shoes inwardly during a swaging process, said piston member including a recess formed frusto-conically and divided into a plurality of circumferentially disposed bearing surface zones of a defined axial length, each said bearing surface zone having an inner axial end with a numerical radius of curvature less than or equal to that of the frusto-conically formed region of said piston at said inner axial end of the bearing surface zone, and wherein said numerical radius of curvature of the inner end of said bearing surface zone is equal to a radius of curvature of an outer end of said bearing surface zone.

29. A swaging press according to claim 28 wherein the inner axial end of each said bearing zone has a numerical radius of curvature less than that of the frusto-conically formed region of said piston at said inner axial end of the bearing surface zone.

30. A swaging press according to claim 28 wherein the radius of curvature of each said bearing surface zone is uniform along the axial length of said bearing surface zone.

31. A swaging press according to claim 28 wherein at each circumferential position, at least two said bearing surface zones are provided axially in line separated by a ramp surface forming an angle to the direction of movement of the piston member greater than that of each of said bearing surface zones.

32. A swaging press according to claim 28 wherein a die shoe is provided co-operable with each said bearing surface zone, each said die shoe having an outer bearing surface circumferential zone engageable with a substantial portion of the adjacent said bearing surface zone over a substantial part of the movement of said piston member during a swaging operation.

* * * * *